US006393964B1

(12) United States Patent
Katayama et al.

(10) Patent No.: US 6,393,964 B1
(45) Date of Patent: May 28, 2002

(54) COMPRESSOR HAVING PISTON ROTATION RESTRICTING STRUCTURE WITH LUBRICATING INCLINED GUIDE SURFACE

(75) Inventors: Seiji Katayama; Takayuki Kato, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/678,532

(22) Filed: Oct. 3, 2000

(30) Foreign Application Priority Data

Oct. 12, 1999 (JP) ..... 11-289871

(51) Int. Cl.[7] ..... F01B 3/00

(52) U.S. Cl. ..... 92/71; 92/154; 92/155; 92/159

(58) Field of Search ..... 92/71, 154, 155, 92/159

(56) References Cited

U.S. PATENT DOCUMENTS 5,490,767 A * 2/1996 Kanou et al. ..... 92/71
5,706,716 A * 1/1998 Umemura ..... 92/71
5,842,406 A 12/1998 Hiramatsu et al. ..... 92/158
5,988,041 A 11/1999 Hiramatsu et al. ..... 92/71
6,010,313 A * 1/2000 Kimura et al. ..... 92/71
6,123,513 A * 9/2000 Hiramatsu et al. ..... 92/71

FOREIGN PATENT DOCUMENTS

JP A-8-109874 4/1996
JP A-10-196539 7/1998

* cited by examiner

*Primary Examiner*—F. Daniel Lopez
(74) *Attorney, Agent, or Firm*—Woodcock Washburn LLP

(57) ABSTRACT

The compressor having pistons and a swash plate, the pistons including head portions reciprocatingly inserted in the cylinder bores and neck portions connected to the head portions. A piston rotation restricting structure includes a first rotation restricting member formed with the neck portion of each piston, and a second rotation restricting member provided in the housing. An inclined guide surface is formed in one end surface of the first rotation restricting member and inclined toward the outer peripheral surface for guiding lubricant from the crank chamber into a gap between the first and second rotation restricting members. The inclined guide surface is formed by a single flat surface or two flat surfaces, or in a recessed shape.

13 Claims, 5 Drawing Sheets

COMPRESSOR HAVING PISTON ROTATION RESTRICTING STRUCTURE WITH LUBRICATING INCLINED GUIDE SURFACE

BACKGROUND OF THE INVENTION

1. Field of the Invention

The present invention relates to a compressor, for compressing a refrigerant gas, which can be applied to, for example, an air-conditioner incorporated in a vehicle. More particularly, the present invention relates to compressor having a piston rotation restricting structure for restricting rotation of a piston around the axis of the piston itself.

2. Description of the Related Art

A compressor of the above type will be explained as follows. A crank chamber is formed in a housing, and a drive shaft extends through the crank chamber and is rotatably supported by the housing. A swash plate is connected to the drive shaft in the crank chamber so that the swash plate can be rotated with the drive shaft. Cylinder bores are formed in the cylinder block composing a portion of the housing. The piston has a head portion and a neck portion which are axially connected with each other. The head portion of the piston is inserted in the cylinder bore, and the neck portion of the piston is located in the crank chamber outside the cylinder bore. Shoes are housed in this neck portion. The piston is connected to the swash plate via the shoes. Rotation of the swash plate caused by rotation of the drive shaft is converted into a reciprocating motion of the piston via the shoes. Therefore, refrigerant gas is compressed in the cylinder bore.

In the compressor constructed as described above, since the piston is connected to the swash plate via the shoes, and the piston tends to rotate around the axis of the piston itself, vibration and noise are possibly caused by the interference of the neck portion of the piston with the swash plate which rotates at high speed. Therefore, a piston rotation restricting structure is provided in the above compressor. That is, a piston side rotation restricting member is arranged in the neck portion of the piston. A housing side rotation restricting member is provided in the housing at the crank chamber to engage with the piston side rotation restricting member while allowing reciprocating motion of the piston. Rotation of the piston around the axis of the piston itself is restricted by the engagement of the piston side rotation restricting member with the housing side rotation restricting member.

However, when the above rotation restricting structure is provided, a new problem is caused in which the number of sliding portions between the piston and the housing is increased, that is, a sliding portion, between both the rotation restricting sections, is newly added to the number of the sliding portions. Therefore, power loss caused in the compressor is increased. In order to solve the above problem, there is proposed, as a countermeasure, to form an abrasion-resistant coating, for example, on the piston side rotation restricting member. However, even if an abrasion-resistant coating is provided, it has a problem of durability that it will be worn out by the repetition of sliding motion between the piston side rotation restricting member and the housing side rotation restricting member.

In this case, the crank chamber is supplied with refrigerant gas which enters the crank chamber, for example, as blow-by gas. This refrigerant gas contains mist of lubricant. If the supplied lubricant into the crank chamber can be supplied to a gap between the piston side rotation restricting member and the housing side rotation restricting member, fluid lubrication can be effectively accomplished between both sliding rotation restricting members. However, the lubricant supplied into the crank chamber is pushed back by the end surface of the neck portion of the reciprocating piston. Therefore, only a small quantity of lubricant enters a gap between both rotation restricting members.

SUMMARY OF THE INVENTION

The present invention is accomplished to solve the above problems of the prior art. It is an object of the present invention to provide a compressor having a piston rotation restricting structure capable of supplying a sufficiently large quantity of lubricant from the crank chamber to a gap between the piston side rotation restricting member and the housing side rotation restricting member.

In order to accomplish the above object, according to the present invention, there is provided a compressor comprising: a housing having cylinder bores and a crank chamber; pistons having head portions and neck portions arranged such that the head portions are reciprocatingly inserted in the cylinder bores and the neck portions connected to the head portions; a drive shaft extending through the crank chamber and rotatably supported by the housing; a cam plate such as a swash plate arranged in the crank chamber and rotatable with the drive shaft; shoes arranged between the cam plate and the neck portions of the pistons; a piston rotation restricting structure comprising a first rotation restricting member formed on the neck portion of each piston, and a second rotation restricting member provided in the housing so that the first rotation restricting member can contact the second rotation restricting member to restrict rotation of the piston about its own axis while allowing reciprocating motion of the piston; the first rotation restricting member comprising axially spaced end surfaces, and an outer peripheral surface between the end surfaces; and an inclined guide surface formed in one end surface of the first rotation restricting member and inclined toward the outer peripheral surface for guiding lubricant from the crank chamber into a gap between the first rotation restricting member and the second rotation restricting member when the piston moves in one direction or in the other direction.

In this compressor, lubricant is introduced from the crank chamber into the inclined guide surface by the reciprocating motion of the piston and supplied to a gap between the first rotation restricting member and the second rotation restricting member. Accordingly, it is possible to supply a sufficiently large quantity of lubricant to a gap between the first rotation restricting member and the second rotation restricting member. Accordingly, fluid lubrication can be effectively accomplished between both sliding rotation restricting members.

Preferably, the inclined guide surface comprises a single flat surface. When this structure is adopted, the inclined guide surface can be easily machined.

Preferably, the inclined guide surface comprises a flat surface and guide walls provided on both sides of the flat surface so that the entire inclined guide surface is formed into a recessed shape. Preferably, the entire inclined guide surface is formed into a recessed shape in which a plurality of flat surfaces, which are arranged in parallel to the axis of the piston and are connected with each other at a merging bottom line. Preferably, the inclined guide surface is composed of a concavity on which the central portion is deeper than both the side portions.

According to the above structure, most of the lubricant introduced into the inclined guide surface by the reciprocating motion of the piston is prevented, by the inclined guide surface which is formed into a recessed shape, from leaking out onto the sides. Therefore, the lubricant can be positively supplied to both the rotation restricting members.

Preferably, an abrasion-resistant coating is provided on at least one of an engaging surface of the first and second rotation restricting members.

According to the above structure, even when an absolute quantity of lubricant in the crank chamber is small so that a sufficiently effective fluid lubrication cannot be accomplished between both the rotation restricting members, the first and second rotation restricting members can slide on each other with a low friction coefficient by solid lubrication conducted by the abrasion-resistant coating. On the contrary, when an absolute quantity of lubricant in the crank chamber is large, a sufficiently large quantity of lubricant can be supplied to a gap between both the rotation restricting members by the inclined guide surface. Therefore, the main lubrication between both the rotation restricting members changes from solid lubrication conducted by the abrasion-resistant coating to fluid lubrication conducted by lubricant, and at the same time, the abrasion-resistant coating is protected by the fluid lubrication. Therefore, the durability can be enhanced.

Preferably, the inclined guide surface is formed on one end face of the first rotation restricting member located on the side opposite to the head portion.

In the above structure, the inclined guide surface of the piston can be easily performed, for example, finish grinding can be easily conducted on the inclined guide surface, because one end face opposed to the head portion of the first rotation restricting member is a terminal end face of the piston part and the inclined guide surface can be easily machined here. However, one end face on the side of the head portion of the first rotation restricting member is located in the middle of the piston part in the axial direction. Therefore, it is difficult to conduct machining of the inclined guide surface on this face.

Preferably, one arrangement of the second rotation restricting member which is desirable at present is realized. Thus, the second rotation restricting member comprises an inner peripheral surface of the housing surrounding the crank chamber around the drive axis.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
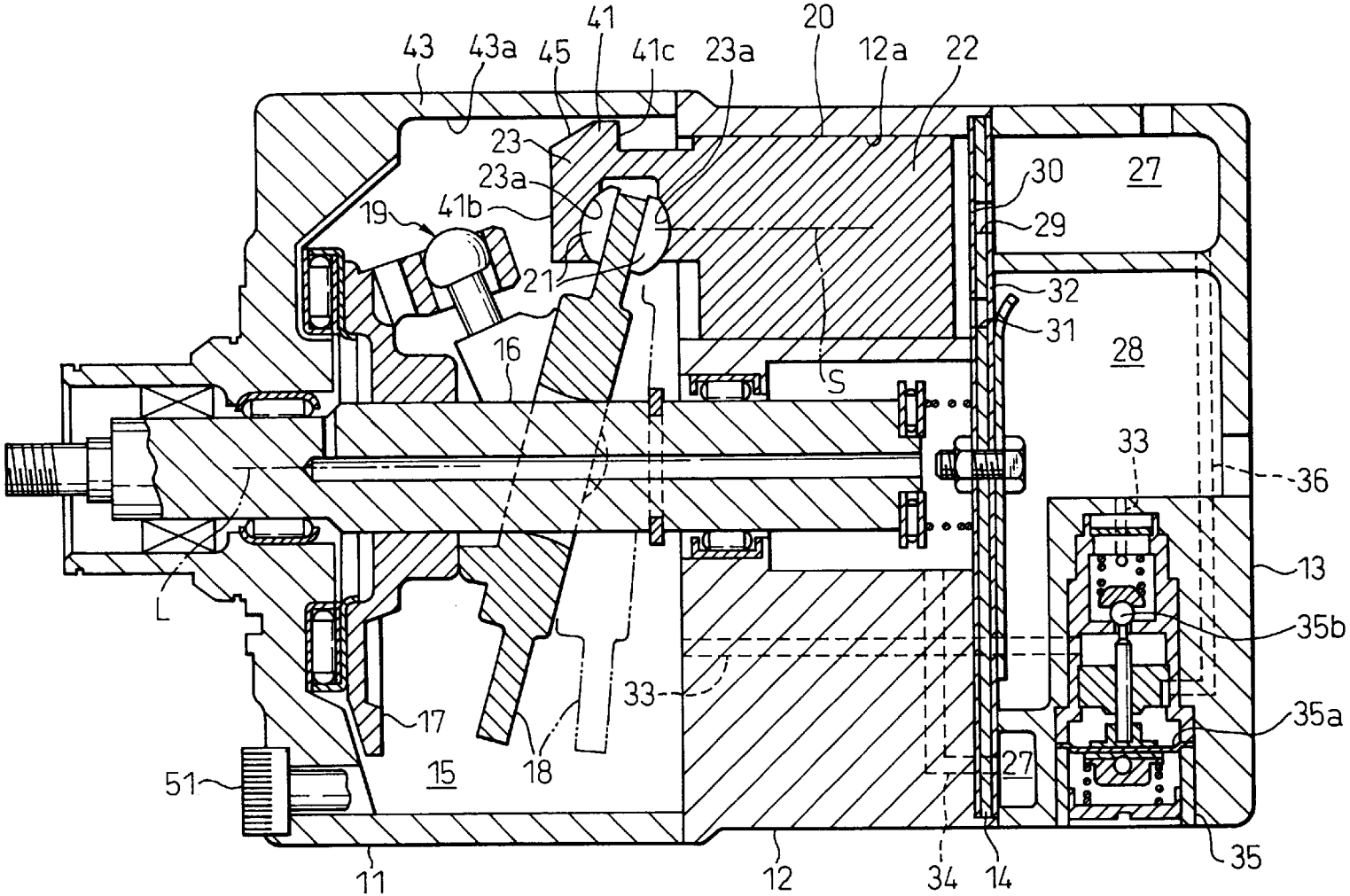
FIG. 1 is a longitudinally cross-sectional view of a single headed piston type, variable capacity compressor.

The present invention will now be described with reference to the first to fifth embodiments in which the present invention is realized as a single headed piston type, variable capacity compressor which is applied to an air-conditioner for vehicle. In this connection, concerning the second to the fifth embodiments, only points different from the points of the first embodiment will be explained, and like reference characters are used to indicate like parts and repeated explanations are omitted.

FIGS. 1 to 4 show the first embodiment of the present invention. As shown in FIG. 1, a front housing 11 made of metallic aluminum material is joined to the front end of a cylinder block 12 as a center housing, and a rear housing 13 is joined to the rear end of the cylinder block 12 via a valve and port forming plate assembly 14. These housing members 11 to 13 are fastened and fixed to each other by a plurality of through-bolts 51 which extend through these housing members (only one through-bolt is schematically shown in the drawing). The front housing 11, the cylinder block 12 and the rear housing 13 constitute a housing assembly of the variable capacity compressor.

A crank chamber 15 is defined in the front housing 11 and the cylinder block 12. A drive shaft 16 is rotatably supported by the front housing 11 and the cylinder block 12 in such a manner that the drive shaft 16 extends through the crank chamber 15. Although not shown in the drawing, the drive shaft 16 is connected to a vehicle engine as an external drive source, via a clutch mechanism such as an electromagnetic clutch. Accordingly, the drive shaft 16 is driven by the vehicle engine when the clutch mechanism is turned on while the engine is operating.

A rotary support body 17 is attached to the drive shaft 16 in the crank chamber 15. A swash plate 18, which functions as a cam plate, is tiltably supported by the drive shaft 16. A hinge mechanism 19 is interposed between the rotary support body 17 and the swash plate 18. The swash plate 18 can be rotated with the drive shaft 16 by the hinge connection between the swash plate 18 and the rotary support body 17 via the hinge mechanism 19. At the same time, the swash plate 18 can be tilted with respect to the drive shaft 16.

A plurality of cylinder bores 12*a* are formed in the cylinder block 12 around an axis L of the drive shaft 16 (only one cylinder bore 12*a* is shown in the drawing). Single headed type pistons 20 are arranged in the cylinder bores 12*a*. The piston 20 is connected to the swash plate 18 via shoes 21. Accordingly, a rotary motion of the drive shaft 16 is converted into a reciprocating motion of the pistons 20 in the cylinder bores 12*a* via the swash plate 18 and the shoes 21.

A suction chamber 27 and a discharge chamber 28 are respectively defined in the rear housing 13. Suction ports 29, suction valves 30, discharge ports 31 and discharge valves 32 are respectively formed in the valve and port forming plate assembly 14. Refrigerant gas is sucked from the suction chamber 27 into the cylinder bore 12*a* via the suction port 29 and the suction valve 30 when the piston 20 is moved (in the one direction) from the top dead center position to the bottom dead center position. Refrigerant gas sucked in the cylinder bore 12*a* is compressed to a predetermined pressure when the piston 20 is moved (in the opposite direction) from the bottom dead center position to the top dead center position. After that, the compressed refrigerant gas is discharged into the discharge chamber 28 via the discharge port 31 and the discharge valve 32.

A supply passage 33 connects the discharge chamber 28 to the crank chamber 15. An extraction passage 34 connects the crank chamber 15 to the suction chamber 27. A capacity control valve 35 is arranged in the supply passage 33. A pressure sensitive passage 36 connects the suction chamber 27 to the capacity control valve 35. The capacity control valve 35 includes a diaphragm 35*a*, which is a pressure sensitive member, and a valve body 35*b* connected to the diaphragm 35*a*.

The capacity control valve operates the valve body 35*b*, so that the degree of opening of the supply passage 33 can be changed when the diaphragm 35*a* reacts to the suction pressure of the suction chamber 27 introduced through the pressure sensitive passage 36. When the degree of opening of the supply passage 33 is changed, the amount of refrigerant gas introduced into the crank chamber 15 is changed, and according to the relationship with the amount of refrigerant gas which is released to the suction chamber 27 via the extraction passage 34, the pressure in the crank chamber 15 is changed. Accordingly, a difference between the pressure in the crank chamber 15 and the pressure in the cylinder bore 12*a* via the piston 20 is changed, and an inclination angle of the swash plate 18 is changed as shown by two-dotted chain lines in FIG. 1. As a result, a stroke of the piston 20 is changed, and a discharge capacity of the compressor is adjusted.

Next, the structure of the piston 20 and the rotation restricting structure of the piston 20 will be described below in detail.

Figure 2:
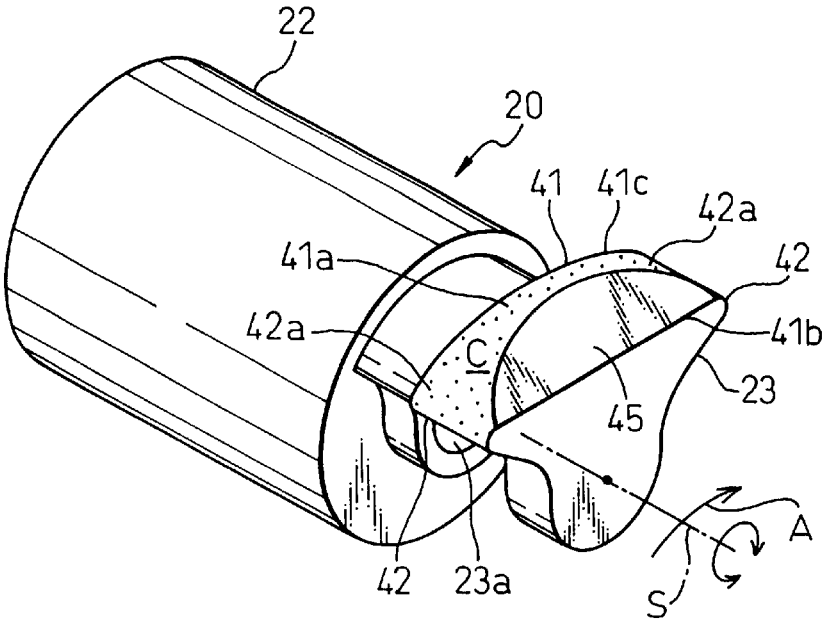
FIG. 2 is a perspective view of the piston of FIG. 1.

As shown in FIGS. 1 and 2, the piston 20 has a cylindrical head portion 22, which is inserted in the cylinder bore 12*a*, and a neck portion 23, which is located in the crank chamber 15 outside the cylinder bore 12*a*, these portions being integrally connected with each other in the direction of an axis S. The head portion 22 and the neck portion 23 are made of metallic aluminum material. A pair of shoe seats 23*a* are arranged in the neck portion 23. A pair of shoes 21 are provided in the neck portion 23 and respectively received by the pair of shoe seats 23*a* by means of spherical contact. A front surface and a back surface of the outer periphery of the swash plate 18 are slidably interposed between the pair of shoes 21.

Figure 3:
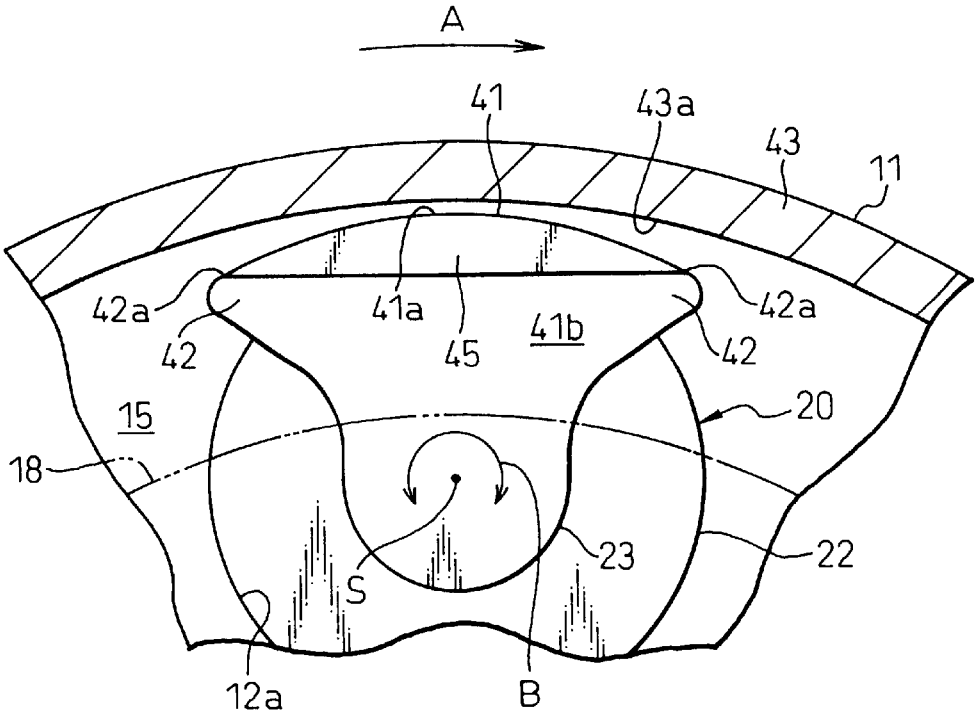
FIG. 3 is a rear view of the piston, with a portion of the housing.

As shown in FIGS. 2 and 3, a first piston side rotation restricting member 41 is provided in the neck portion 23 of the piston 20. The piston side rotation restricting member 41 has a pair of contact engaging portions 42 projecting to the leading side and the trailing side in the rotational direction of the swash plate 18. Contact engaging surfaces 42*a* on the piston 20 are formed as the outer peripheral surface of the piston side rotation restricting member 41 at the contact engaging portions 42, opposed to the circumferential wall 43 of the front housing 11 in the crank chamber 15. The circumferential wall 43 of the front housing 11 constitutes a second, housing side rotation restricting member 43. In this housing side rotation restricting member 43, an inner peripheral surface 43*a*, which is a circular arcuate concave surface formed around the axis L of the drive shaft 16, forms a contact engaging surface 43*a* on the housing side. Connecting surface 41*a* of the piston side rotation restricting member 41 is provided between both the contact engaging portions 42, and the contact engaging surfaces 42*a* of both the contact engaging portions 42 are connected to each other via the connecting surface 41*a*. Both the contact engaging surfaces 42*a* and the connecting surface 41*a* are arranged on the common arcuate convex surface, so that they can be easily machined with respect to the piston 20. That is, by only rotating the piston 20 around the axis of the arcuate convex surface under the condition that a polishing tool is set at a fixed position, the surfaces 42*a* and 41*a* can be polished by a polishing tool. The radius of curvature of the arcuate convex surface is larger than that of the outer peripheral surface of the piston, but smaller than that of curvature of the contact engaging surface 43*a* on the housing side.

As shown by the arrows A and B in FIG. 3, due to the connecting structure of the piston 20 with the swash plate 18 via the shoes 21, the piston 20 tends to rotate around its own axis S. The arrow A shows the rotational direction of the swash plate 18, and the arrow B shows the possible rotational direction of the piston 20. Accordingly, when the piston 20 receives an external force for some reason, it may be rotated around its axis S. When the shoes 21 slide on the swash plate 18, the shoes 21 are apt to be rotated in the same rotational direction as that of the swash plate 18, that is, the shoes 21 are rotated clockwise in the drawing. That is, due to a difference between the circumferential speed of the swash plate 18 at a radially outer position and that at a radially inner position, with the former being higher than the latter, the shoes 21 are given a rotational force in the same direction as that of the rotational direction of the swash plate 18. Therefore, when the compressor is operated, the piston 20 tends to rotate in the same direction as that of the rotational direction of the swash plate 18 by the rotational force of the swash plate 18 given to it via the shoes 21.

However, the rotation of the piston 20 in the same direction as that of the rotational direction of the swash plate 18 is restricted, by engaging the contact engaging surface 42*a* of one contact engaging portion 42 (on the left in FIG. 3) of the piston side rotation restricting member 41 with the contact engaging surface 43*a* of the housing side rotation restricting member 43, and rotation of the piston 20 in the direction opposite to the rotational direction of the swash plate 18 is restricted by engaging the contact engaging surface 42*a* of the other contact engaging portion 42 (on the right in FIG. 3) with the contact engaging surface 43*a* of the housing side rotation restricting member 43. Accordingly, for example, a portion of the piston 20 close to the neck portion 23 does not interfere with the swash plate 18. Therefore, it is possible to prevent occurrence of vibration and noise caused by interference of the piston 20 with the swash plate 18 rotating at high speed.

Next, characteristics of this embodiment will be explained below.

The provision of the above rotation restricting structure of the piston 20 causes a new problem, in which the number of sliding portions between the piston 20 and the housing 11 to 13 is increased, that is, the number of sliding portions between both the rotation restricting members 41 and 43 is increased, and the power loss in the compressor is increased. In order to solve the above problems, lubricant existing in the crank chamber 15 is sufficiently supplied to a gap between the rotation restricting members 41 and 43 so as to accomplish an effective liquid lubrication between the rotation restricting members 41 and 43 in this embodiment.

That is, in order to move the lubricant existing in the crank chamber 15 to a gap between the rotation restricting members 41 and 43, a relative movement between the rotation restricting members 41 and 43, which is caused by the reciprocating motion of the piston 20, is used. However, as described in the description of the prior art, in this structure, most of lubricant is pushed away by the end faces 41*b* and 41*c* of the neck portion 23, and it is difficult to supply a sufficiently large quantity of lubricant to a gap between the rotation restricting members 41 and 43.

Therefore, as shown in FIGS. 1 to 4, an inclined guide surface 45 is provided in the piston side rotation restricting member 41, so that a wedge-shaped space directed (converged) in the direction of axis S of the piston 20 is formed between the inclined guide surface 45 and the contact engaging surface 43*a* of the housing side rotation restricting member 43. Accordingly, when the piston 20 is reciprocated, a wedge action occurs between the inclined guide surface 45 and the contact engaging surface 43*a*, and a quantity of lubricant in the crank chamber 15 including portion, which would be otherwise pushed away by the end surface 41*b* of the neck portion 23 if the inclined guide surface 45 is not provided, can be taken into the wedge-shaped space and introduced into a gap between the rotation restricting members 41, 43.

Figure 4:
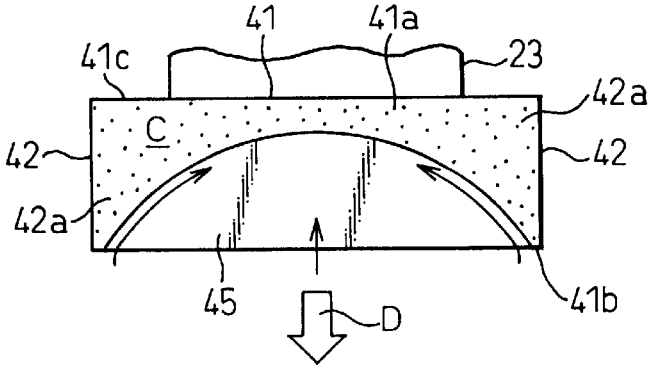
FIG. 4 is a plan view of a portion of the piston including the neck portion.

The inclined guide surface 45 is formed as a single flat surface in such a manner that the end surface 41*b* on the side opposite to the head portion 22 of the piston side rotation restricting member 41 is cut off to the great extent. The piston side rotation restricting member 41 is formed in such a convex shape that the central portion thereof is higher than the side portions and, as clearly shown in FIGS. 2 and 4, the ridge line of the inclined guide surface 45 approaches the other end surface 41*c* as the position approaches the center. Accordingly, as shown in FIG. 4, the inclined guide surface 45 collects the lubricant to the center and introduces it into a gap between the rotation restricting members 41 and 43, only when the piston 20 is moved from the top dead center to the bottom dead center in the reciprocating motion of the piston 20 (the suction stroke). The arrow D shows the movement of the piston in the suction stroke.

As illustrated by dots in FIGS. 2 and 4, an abrasion-resistant coating C is formed on the contact engaging surfaces 42*a* and the connecting surface 41*a* of the piston side rotation restricting member 41. The abrasion-resistant coating C is made of a fluoro resin such as PTFE (polytetrafluoroethylene) as a solid lubricant. For example, the thickness of the abrasion-resistant coating C is 20 $\mu$m to 40 $\mu$m.

Lubricant is supplied into the crank chamber 15, along with refrigerant gas which is delivered through the cylinder bores 12*a* as a blow-by gas or through the supply passage 33, in addition to the lubricant initially supplied into the crank chamber 15.

The lubricant existing in the crank chamber 15 in this way is effectively taken into a gap between the piston side rotation restricting member 41 and the housing side rotation restricting member 43 by the action of the inclined guide surface 45 caused by the reciprocating motion of the piston 20 as described above. Therefore, it is possible to accomplish an effective fluid lubrication between the rotation restricting members 41 and 43, especially between the contact engaging surfaces 42*a* and 43*a*. That is, it is possible to conduct a low frictional sliding motion between the contact engaging surfaces 42*a* and 43*a*.

However, the lubricant existing in the crank chamber 15 flows to the outside of the crank chamber 15 together with the refrigerant gas via the extraction passage 34, and an absolute quantity of lubricant in the crank chamber 15 is decreased in some cases, due to the relationship of the incoming lubricant supplied by blow-by gas or through the supply passage 33 and the extracted lubricant. In this case, the primary lubrication conducted between the piston side rotation restricting member 41 and the housing side rotation restricting member 43 is ensured by the solid lubrication conducted by abrasion-resistant coating C, rather than liquid lubrication conducted by lubricant, so a low frictional sliding motion can be maintained between the piston side rotation restricting member 41 and the housing side rotation restricting member 43.

The following effects can be provided by this embodiment.

(1) By the provision of the inclined guide surface 45, it is possible to accomplish an effective fluid lubrication between the piston side rotation restricting member 41 and the housing side rotation restricting member 43, that is, it is possible to accomplish a low frictional sliding motion between the piston side rotation restricting member 41 and the housing side rotation restricting member 43. Accordingly, even if the rotation restricting structure of the piston 20 is provided, an increase in power loss of the compressor can be reduced, and thus, it is possible to reduce a load given to the engine. Also, the provision of the inclined guide surface 45 formed in the piston 20 means that a portion of the material of the piston 20 is taken away, so the weight of the piston 20 is lightened at the same time. In order to enhance this effect of reducing the weight, it is necessary to increase the size of the inclined guide surface 45 as much as possible.

(2) The flat inclined guide surface 45 can be easily machined, and the manufacturing cost of the piston 20 can be reduced.

(3) The abrasion-resistant coating C is formed on the contact engaging surface 42*a* of the piston side rotation restricting member 41. Accordingly, even if an absolute quantity of lubricant in the crank chamber 15 is small and an effective fluid lubrication cannot be expected between the rotation restricting members 41 and 43, a low frictional sliding motion between the rotation restricting members 41 and 43 can be ensured by the abrasion-resistant coating C. Therefore, an increase in power loss of the compressor can be prevented. In the case where an absolute quantity of lubricant in the crank chamber 15 is large and an effective fluid lubrication is accomplished between the piston side rotation restricting member 41 and the housing side rotation restricting member 43, abrasion-resistant coating C is protected by this fluid lubricant and therefore, abrasion-resistant coating C can be used over a long period of time.

(4) The inclined guide surface 45 is formed in the end surface 41*b* located on the side opposite to the head portion 22 in the piston side rotation restricting member 41. Accordingly, machining of the inclined guide surface 45 of the piston 20 can be easily performed, for example, finish grinding can be easily conducted to form the inclined guide surface 45, because the end surface 41*b* opposite to the head portion 22 of the piston side rotation restricting member 41 is a terminal end surface of the piston 20 and the inclined guide face 45 can be easily machined. However, the end surface 41*c* of the piston side rotation restricting member 41 on the side of the head portion 22 is located in the middle of the piston part in the direction of axis S, and it is difficult to conduct machining of the inclined guide surface 45.

(5) In the variable capacity type compressor, the capacity can be changed by adjusting the pressure in the crank chamber 15. That is, the crank chamber 15 is a pressure control chamber used for adjusting the discharge capacity, and the crank chamber 15 does not exist in the refrigerant circulating circuit composing a refrigerating cycle of an air-conditioner for vehicle use. Accordingly, it is impossible to expect that a large quantity of refrigerant gas containing lubricant flows in the crank chamber 15. The fact that the structure for supplying lubricant positively to a gap between the rotation restricting members 41 and 43 (inclined guide surface 45) is applied to the crank chamber 15 which is put into such a severe lubricating condition, can provide a particularly good effect.

Figure 5:
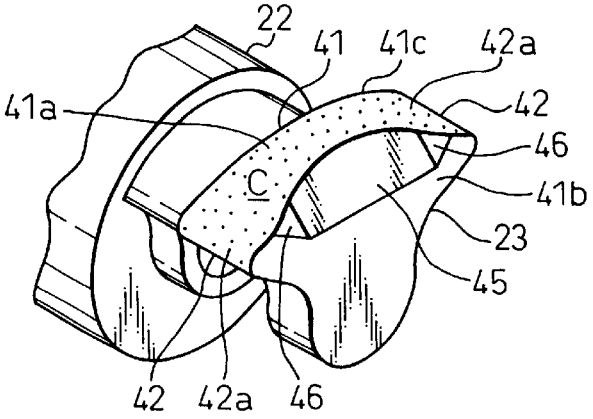
FIG. 5 is a perspective view of a portion of the piston including the neck portion of the second embodiment.
Figure 6A:
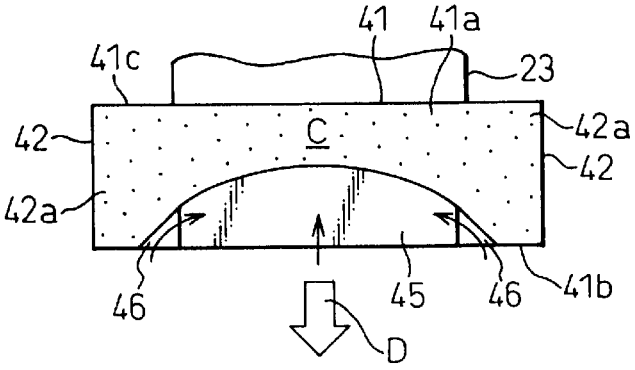
FIG. 6A is a plan view of a portion of the piston including the neck portion of FIG. 5.
Figure 6B:
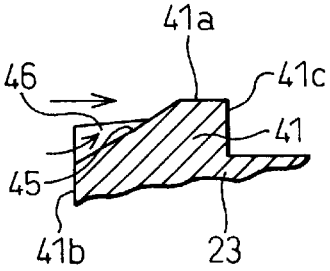
FIG. 6B is a cross-sectional view of the portion of the piston of FIG. 6A.

FIGS. 5 to 6B are views showing the second embodiment of the present invention. In this embodiment, the central region of the inclined guide surface 45 is composed of a flat surface. That is, the inclined guide surface 45 is formed in such a manner that only the central region (corresponding to the position of the connecting surface 41*a* between the contact engaging surfaces 42*a*) is greatly cut in the end surface 41*b* of the piston side rotation restricting member 41, and guide walls 46 are formed on both sides of the inclined guide surface 45 so as to upwardly extend from this inclined surface 45. Therefore, the entire profile of the inclined guide surface 45 is formed into a recessed shape.

This embodiment can provide the same effect as that of the first embodiment described above. Further, the inclined guide surface 45 and 46 is formed into a recessed shape, so it is possible to positively prevent lubricant, which is guided to a gap between the piston side rotation restricting member 41 and the housing side rotation restricting member 43, from leaking out to both sides of the inclined guide surface 45 (wedge-shaped space). Accordingly, lubricant can be positively supplied to a gap between both the rotation restricting members 41 and 43.

Figure 7:
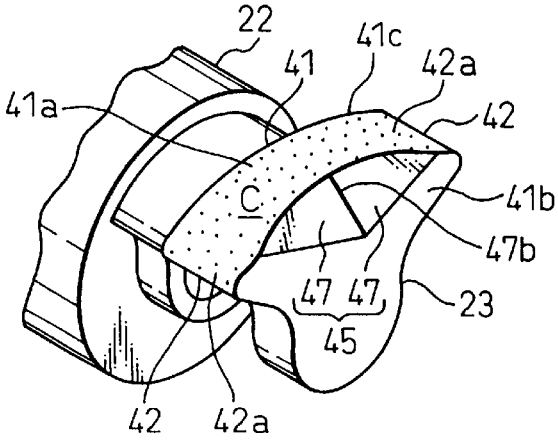
FIG. 7 is a perspective view of a portion of the piston including the neck portion of the third embodiment.
Figure 8:
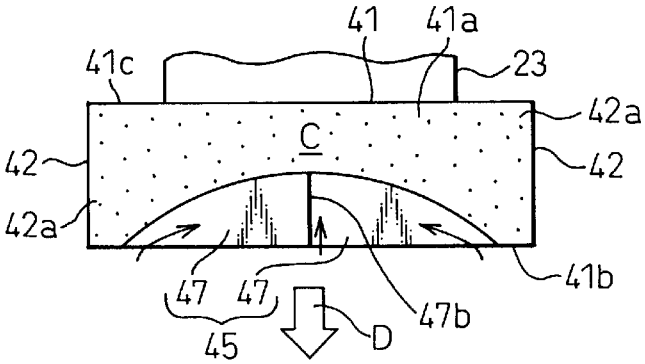
FIG. 8 is a plan view of a portion of the piston including the neck portion of FIG. 7.

FIGS. 7 and 8 are views showing the third embodiment of the present invention. In this embodiment, the inclined guide surface 45 is composed of a plurality of flat surfaces (two flat surfaces) 47 which are arranged symmetrically with respect to the axis S of the piston 20 and not arranged in the same plane, and the flat surfaces 47 are connected to each other at a merging bottom line 47*b*, so that the entire profile of the inclined guide surface 45 is formed into a recessed shape.

This embodiment can provide the same effect as that of the second embodiment described above.

Figure 9:
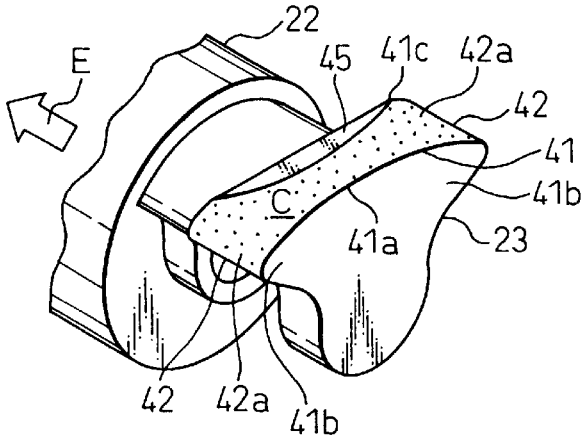
FIG. 9 is a perspective view of a portion of the piston including the neck portion of the fourth embodiment.

The fourth embodiment is shown in FIG. 9. In this embodiment, the inclined guide surface 45 is formed in the end surface 41*c* of the piston side rotation restricting member 41 on the side of the head portion 22. Accordingly, only when the inclined guide surface 45 is moved from the bottom dead center position to the top dead center position in the reciprocating motion of the piston 20, as shown the arrow E, that is, only in the compression and the discharge stroke, does the inclined guide surface 45 effectively introduce lubricant into a gap between the piston side rotation restricting member 41 and the housing side rotation restricting member 43.

In this embodiment, it is possible to provide the same effect as that of the first embodiment except for item (4).

Figure 10:
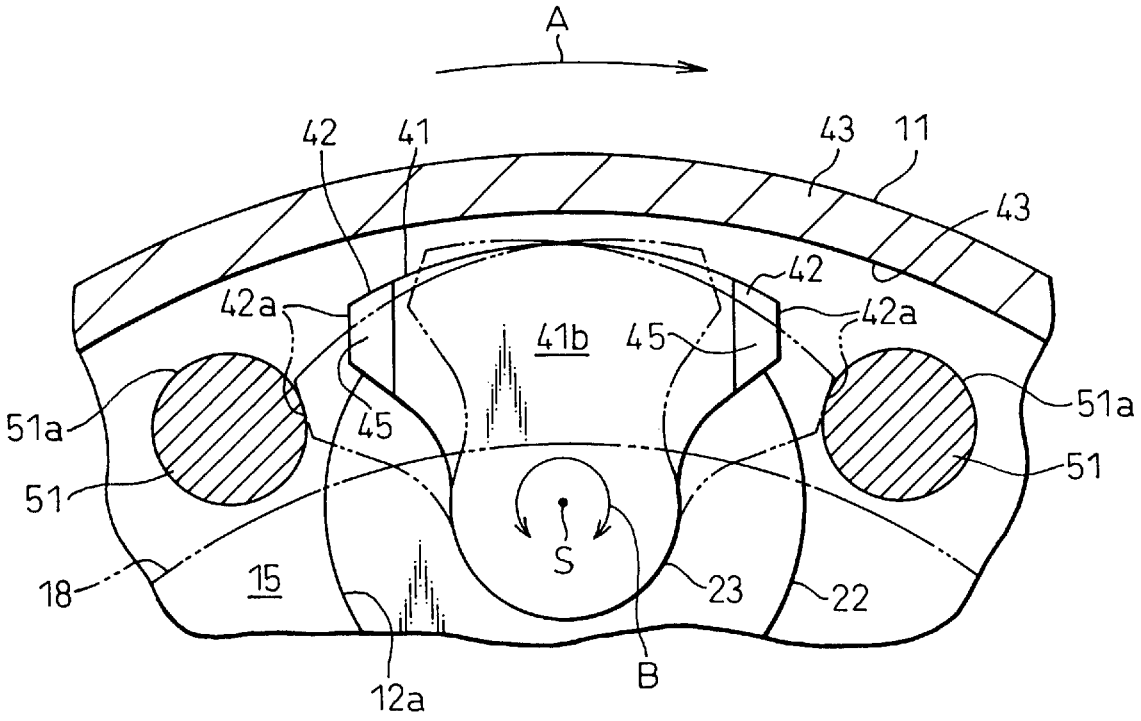
FIG. 10 is a rear view of the piston of the fifth embodiment, with a portion of the housing.

The fifth embodiment is shown in FIG. 10. In this embodiment, the rotation restricting structure of the piston 20 is different from that of the first embodiment. That is, a pair of through-bolts 51 pass through the crank chamber 15 near the neck portion 23 of the piston 20. These through-bolts 51 compose the housing side rotation restricting member. As shown by two-dotted chain lines in the drawing, rotation of the piston 20 around its own axis S is restricted when the contact engaging surface 42*a* of the contact engaging member 42 comes into contact with the outer circumferential surface 51*a* of the bolt which is a contact engaging surface of the bolt 51. Inclined guide surfaces 45 are arranged on the end surface 41*b* of the piston side rotation restricting member 41 at circumferentially opposite sides.

In this embodiment, it is possible to provide the same effect as that of the first embodiment.

In this connection, it is possible to adopt the following embodiment without departing from the spirit and scope of the present invention.

In the first embodiment described above, the inclined guide surface 45 is formed into a concave shape in which the center thereof is deeper than both sides thereof. Due to the foregoing, most of lubricant which enters the wedge-shaped space is moved to the central side having a sufficiently large space. In other words, lubricant does not leak out from the inclined guide surface 45 (wedge-shaped space) to either sides. Accordingly, lubricant can be effectively introduced into a gap between the rotation restricting members 41 and 43.

For example, the first and the fourth embodiments can be combined with each other. That is, the inclined guide surfaces 45 are formed in the end surface 41*b* on the side opposite to the head portion 22 of the piston side rotation restricting member 41 and in the end surface 41*c* on the side of the head portion 22. Due to the above arrangement, in the suction stroke and the compression stroke in the reciprocating motion of the piston 20, lubricant can be effectively introduced into a gap between both the rotation restricting members 41 and 43.

An abrasion-resistant coating C is formed on the contact engaging surface 43*a* of the housing side rotation restricting member 43. In this case, as described in each embodiment described above, the abrasion-resistant coating may be formed or may not be formed on the contact engaging surface 42*a* of the piston side rotation restricting member 43.

It is possible to adopt a piston rotation restricting mechanism of the present invention to a fixed capacity type compressor, in which the swash plate 18 is fixed to the drive shaft 16 and the inclination angle of the swash plate is kept constant.

It is possible to adopt an embodiment having a piston rotation restricting structure of a double headed piston type compressor in which two head portions 22 are provided on both sides of the neck portion 23.

It is possible to adopt an embodiment in which a cam plate is changed from the swash plate to a wave cam in the above described fixed capacity type compressor.

According to the present invention, the structure of which is described above, a sufficiently large quantity of lubricant can be supplied from the crank chamber to between the piston side rotation restricting section and the housing side rotation restricting section. Therefore, an effective fluid lubrication can be accomplished between both the sliding rotation restricting sections.

What is claimed is:

1. A compressor comprising:

a housing having cylinder bores and a crank chamber;

pistons having head portions and neck portions arranged such that said head portions are reciprocatingly inserted in said cylinder bores and said neck portions are connected to said head portions;

a drive shaft extending through said crank chamber and rotatably supported by said housing;

a cam plate arranged in said crank chamber and rotatable with said drive shaft;

shoes arranged between said cam plate and said neck portions of said pistons;

a piston rotation restricting structure comprising a first rotation restricting member formed on said neck portion of each piston, and a second rotation restricting member provided in said housing, said rotation restricting structure restricts rotation of said piston about its own axis while allowing a reciprocating motion of said piston;

said first rotation restricting member comprising axially spaced end surfaces, and an outer peripheral surface between said end surfaces; and an inclined guide surface formed in one end surface of said first rotation restricting member and inclined toward said outer peripheral surface for guiding lubricant from the crank chamber into a gap between said first rotation restricting member and said second rotation restricting member when said piston moves in one direction or in the other direction, wherein said inclined guide surface is shaped such that lubricant is guided toward a center of said inclined guide surface.

2. A compressor according to claim 1, wherein said inclined guide surface comprises a single flat surface.

3. A compressor according to claim 1, wherein said inclined guide surface comprises a flat surface and guide wall surfaces provided on both sides of the flat surface so that the inclined guide surface as a whole is formed into a recessed shape.

4. A compressor according to claim 1, wherein said inclined guide surface comprises a plurality of flat surfaces arranged symmetrically with respect to an axis of the piston and connected with each other at a merging bottom line so that the entire inclined guide surface is formed into a recessed shape.

5. A compressor according to claim 1, wherein the inclined guide surface comprises a concave surface having a central portion and side portions, said central portion being deeper than both side portions.

6. A compressor according to claim 1, wherein an abrasion-resistant coating is provided on and engaging surface of at least one of the first and second rotation restricting members.

7. A compressor according to claim 1, wherein said inclined guide surface is formed on one end surface of the first rotation restricting member located on the side opposite to the head portion.

8. A compressor according to claim 1, wherein said inclined guide surface is formed on one end surface of the first rotation restricting member located on the side of the head portion.

9. A compressor according to claim 1, wherein said second rotation restricting member comprises an inner peripheral surface of the housing surrounding the crank chamber.

10. A compressor according to claim 9, wherein said outer peripheral surface of said first rotation restricting member has circumferentially spaced end portions designed such that one of said end portions contacts the inner peripheral surface of said housing when said piston is rotated.

11. A compressor according to claim 10, wherein said outer peripheral surface of said first rotation restricting member is formed by a circular arcuate surface having a radius of curvature greater than a radius of curvature of the piston and smaller than a radius of curvature of the inner peripheral surface of the housing.

12. A compressor according to claim 10, wherein end regions of said outer peripheral surface of said first rotation restricting member including said end portions are directly connected to said one end surface of said first rotation restricting member, and the remaining region of said outer peripheral surface of said first rotation restricting member between said end regions is connected to said one end surface of said first rotation restricting member via said inclined guide surface.

13. A compressor according to claim 1, wherein said housing includes a plurality of housing parts joined together by bolts, and said second rotation restricting member comprises said bolts.

* * * * *